US006786806B2

(12) United States Patent
Maus, Jr.

(10) Patent No.: US 6,786,806 B2
(45) Date of Patent: Sep. 7, 2004

(54) ROTARY MOWER BLADE SHARPENER

(76) Inventor: Harold D. Maus, Jr., P.O. Box 1483, Lynnwood, WA (US) 98046

( * ) Notice: Subject to any disclaimer, the term of this patent is extended or adjusted under 35 U.S.C. 154(b) by 0 days.

(21) Appl. No.: 10/345,982

(22) Filed: Jan. 17, 2003

(65) Prior Publication Data

US 2004/0142645 A1 Jul. 22, 2004

(51) Int. Cl.[7] ..... B24B 3/00

(52) U.S. Cl. ..... 451/141; 451/89; 451/138; 451/403; 269/32; 269/45; 269/56; 269/76; 269/902; 29/281.1

(58) Field of Search ..... 451/141, 9, 138, 451/89, 403, 372, 421; 269/32, 27, 45, 56, 76, 902; 29/281.1

(56) References Cited

U.S. PATENT DOCUMENTS

| | | | | | |
|---|---|---|---|---|---|
| 817,513 | A | * | 4/1906 | Parker | 269/43 |
| 1,783,019 | A | | 11/1930 | Johnson | |
| 1,945,044 | A | | 1/1934 | Johnson et al. | |
| 2,286,970 | A | * | 6/1942 | Maynard | 451/141 |
| 2,738,624 | A | | 3/1956 | Osborn | |
| 2,912,796 | A | * | 11/1959 | Machovec | 451/141 |
| 3,045,398 | A | * | 7/1962 | McEwan | 451/141 |
| 3,218,059 | A | * | 11/1965 | Andrew | 269/271 |
| 4,495,734 | A | | 1/1985 | Rauch | |
| 4,621,456 | A | * | 11/1986 | Winstanley | 451/141 |
| 4,718,198 | A | | 1/1988 | Komossa et al. | |
| 5,159,784 | A | | 11/1992 | Varner, Sr. | |
| 5,549,508 | A | * | 8/1996 | Searle et al. | 451/141 |
| 5,618,226 | A | | 4/1997 | Ueyama | |
| 5,806,187 | A | * | 9/1998 | Ducret | 30/92 |
| 5,863,035 | A | * | 1/1999 | Howell | 269/246 |
| 5,879,224 | A | * | 3/1999 | Pilger | 451/141 |
| 6,010,394 | A | * | 1/2000 | Dieck et al. | 451/141 |
| 6,554,265 | B2 | * | 4/2003 | Andronica | 269/268 |
| 6,666,758 | B1 | * | 12/2003 | Parrott | 451/349 |

FOREIGN PATENT DOCUMENTS

| | | | |
|---|---|---|---|
| DE | 3841 82 | A1 | 7/1989 |
| DE | 4128483 | A1 | 3/1993 |
| JP | 54-65898 | A | 5/1979 |
| JP | 57-127654 | A | 8/1982 |

* cited by examiner

*Primary Examiner*—Joseph J. Hail, III
*Assistant Examiner*—Anthony Ojini
(74) *Attorney, Agent, or Firm*—Richard C. Litman

(57) ABSTRACT

A mower blade sharpener apparatus has an automatic reciprocating holder means to sharpen lawn mower blades conveniently with any stationary circular flat-faced grindstone with its driving motor affixed to a common base. A housing frame having open opposing sides contains a blade holder with upper and lower securing clamps and a V-shaped cradle. The housing frame is attached by a screw to a carriage automatically moved back and forth a limited distance on a pair of parallel rods to sharpen the lawn mower blade. The housing frame and carriage are driven by a pneumatic system designed with a reciprocating movement of approximately 4 inches in a cycle duration of approximately a second. An on/off pneumatic valve switch automatically shuts off the pneumatic pressure when a semicylindrical shield which covers the blade portion not being sharpened is rotated back away from the blade.

11 Claims, 3 Drawing Sheets

ROTARY MOWER BLADE SHARPENER

BACKGROUND CF THE INVENTION

1. Field of the Invention

The present invention relates generally to abrading. More specifically, the invention is an automatically adjustable abrading sharpener apparatus having an adjustable pitch and a pneumatic valve operated reciprocator for sharpening helical-cut rotary mower blades with a conventional fixed grinding wheel.

2. Description of the Related Art

The relevant art of interest describes various metal implement sharpening machines, but none discloses the present invention. There is a need for an economical, ergonomic, automated pneumatic valve operated mower blade sharpener apparatus adaptable to most fixed grinding wheel apparatus for eliminating the generation of excessive heating of the blade, the requirement for holding the blade manually, and reducing sparks, dust, noise, and danger to the user during the grinding procedure. The related art of interest will be described in the order of perceived relevance to the present invention.

U.S. Pat. No. 1,945,044 issued on Jan. 30, 1934, to Albert M. Johnson et al. and its referenced U.S. Pat. No. 1,783,019 issued on Nov. 25, 1930, to Albert M. Johnson describe reciprocating hydraulically operated honing machines for honing cylindrical metal surfaces such as engine cylinders, bearing bushings and the like. The control mechanism is shown by the earlier patent, and actuated by the main reciprocal member, usually the tool carriage, to act on a valve element or clutch element, depending on whether the machine is driven by hydraulic or mechanical power to control the drive for the reciprocating member. Two vertical housings contain spindle driving shafts and reciprocatory head structures. The honing tools comprise a series of longitudinally positioned and spaced honing stones arranged in retaining heads. The apparatus is distinguishable for requiring two reciprocating driving shafts and limited to honing only cylindrical metal surfaces.

U.S. Pat. No. 2,738,624 issued on Mar. 20, 1956, to William T. Osborn describes a reciprocating sickle mower blade sharpener apparatus using belt action as the reciprocator. The apparatus comprises a blade support and a grinding wheel having a diamond shaped cross-section which is rotatable about its axis in sharpening engagement of the teeth of a blade sequentially, and is bodily movable relative to the teeth to contact the entire cutting teeth surfaces. The blade support is mounted to cooperate with the grinding teeth by moving the blade held thereby slightly relative to the grinding wheel to compensate for the bodily movement of the grinding wheel. The rotation and reciprocation of the grinding wheel is powered by a prime mover through belt transmission means. The apparatus is distinguishable for requiring a bodily movable grinding wheel and limited to contacting the entire cutting teeth having triangular surfaces.

U.S. Pat. No. 5,618,226 issued on Apr. 8, 1997, to Hisashi Ueyama describes an angle-adjustable reciprocating grass cutting blade sharpener. A circular shaped grindstone is held by a fixed upright support which has an arcuate guide slot for tilting the grindstone. The blade mount has a horizontal platform with an arcuate edge which is a downwardly inclined surface for placing the trimmer blade. The blade is moved by hand to sharpen each tooth separately. The apparatus is distinguishable for requiring hand-sharpening, a specifically shaped blade mount and a grindstone on a separate mount which can tilt the grindstone.

U.S. Pat. No. 4,495,734 issued on Jan. 29, 1985, to Hans Rauch describes a grinding arrangement of a chopping cutter incorporated in a drum-chopper machine comprising a vertical cylindrical grinding stone which reciprocates its motion via a piston rod and a working cylinder operated by a control valve. The apparatus is distinguishable for being limited to sharpening only blades of a drum-chopper machine.

U.S. Pat. No. 4,718,198 issued on Jan. 12, 1988, to Werner Komossa et al. describes an apparatus for grinding the cutting edges of multiple knives in a rotary tobacco cutting machine comprising rectangular knives positioned across the width of a rotating drum sharpened by a circular grinding wheel rotated and moved across the width of the rotating drum by a motor on a frame with a V-belt transmission. The grinding wheel can be as wide as the rotary cutting machine. The apparatus is distinguishable for requiring a rotary tobacco cutting machine with rectangular knives and a movable or stationary cylindrical grinding wheel.

U.S. Pat. No. 5,159,784 issued on Nov. 3, 1992, to James E. Varner, Sr. et al. describes a portable apparatus for sharpening knives comprising a grinder with a conical face held in a guide bracket of a cylindrical portable blade sharpener body (motor). The grinding angle is varied for different blades by different grinders having differently angled conical surfaces. The portable tool is distinguishable for adjusting the angle of the sharpened blade tip by requiring differently angled grinding stones.

Japan Patent Application No. 54-65898 A published on May 26, 1979, for Tatsumi Matsumoto describes a stop finger apparatus comprising, as best understood, a semiconductor chip polisher machine having automatic detecting means of the chip position by a finger means, and eliminating any manual regulation in applying the grinder to the chip. The apparatus is distinguishable for being limited to a semiconductor chip polishing machine.

Japan Patent Application No. 57-127654 A published on Aug. 7, 1982, for Eikichi Tanaka describes an automatic 1S grinder for the specific shape of a sickle stock blade comprising a movable grinding belt driven by a motor and controlled by a hydraulic cylinder having an arm to adjust the position of a sickle blade via two oscillating plates on individual pivot pins. The apparatus is distinguishable for being limited to sharpening arcuate sickle blades and requiring a movable grinding belt for different graded areas of a sickle blade.

Germany Patent Application No. DE 38 41 829 A1 published on Jul. 6, 1989, for Zbynek Albrecht et al. describes a grinding device for harvest choppers with a rotationally driven drum having a series of knives on its surface. A hollow cylindrical grinding roll positioned above the drum has a shaft adjustable in two coaxial eccentrics by hydraulic or pneumatic cylinders. The apparatus is distinguishable for requiring a rotating drum with knives for sharpening.

Germany Patent Application No. DE 41 28 483 A1 published on Mar. 4, 1993, for Hans Rauch describes a grinding slide which transverses to-and-fro along a slideway parallel to the rotational axis of the cutting cylinder. This apparatus is analogous to the apparatus discussed in U.S. Pat. No. 4,495,734 above and distinguishable for the same reasons.

None of the above inventions and patents, taken either singularly or in combination, is seen to describe the instant invention as claimed. Thus, a mower blade sharpener solving the aforementioned problems is desired.

SUMMARY OF THE INVENTION

The apparatus is an automatic reciprocating holder means to sharpen lawn mower blades conveniently with any stationary circular flat-edge faced grindstone with its drive motor affixed to a common base. A housing having open opposing sides contains a blade holder with securing means. The housing is automatically moved back and forth a limited distance on parallel rails to sharpen the lawn mower blade. The housing is driven by a hydraulic system designed with a reciprocating movement of approximately 4 inches in a cycle duration of approximately a second.

Accordingly, it is a principal object of the invention to provide an automatic lawn mower blade sharpening apparatus.

It is another object of the invention to provide an automatic lawn mower blade sharpening apparatus providing a reciprocating motion to the lawn mower blade affixed in a housing.

It is a further object of the invention to provide an automatic lawn mower blade sharpening apparatus utilizing a conventional flat side surfaced and fixed grindstone device.

Still another object of the invention is to provide an automatic lawn mower blade sharpening apparatus reciprocating by pneumatic means.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
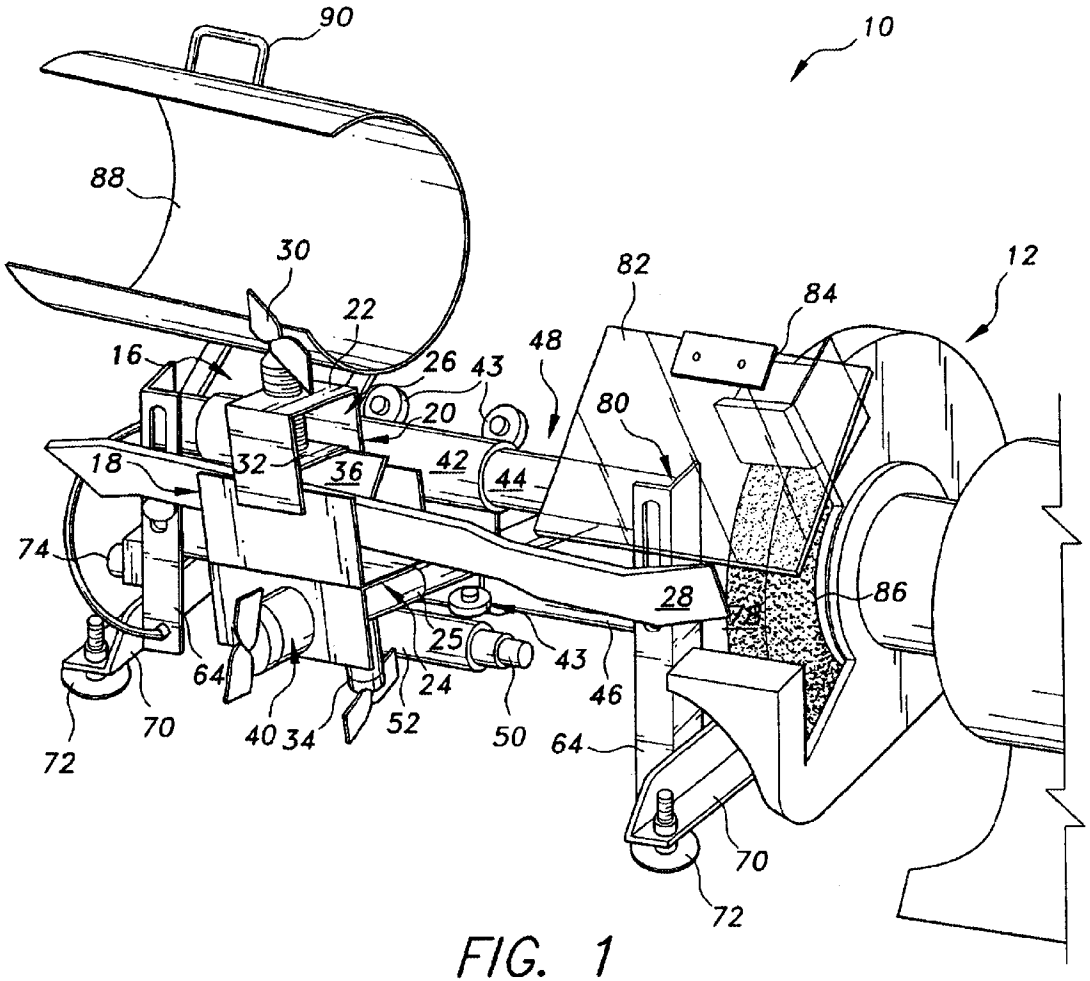
FIG. 1 is a front perspective view of a mower blade sharpener apparatus holding a blade according to the present invention.
Figure 2:
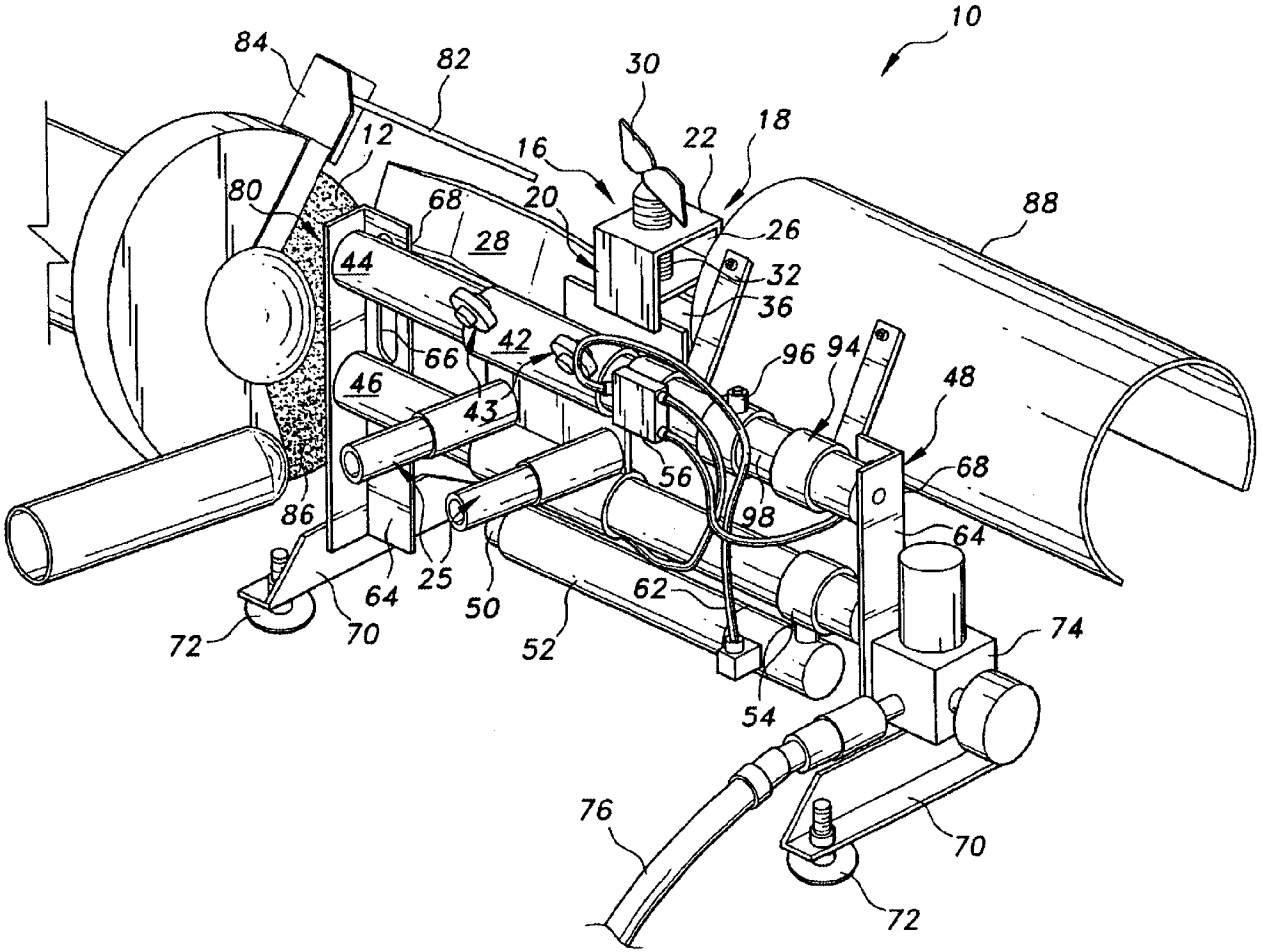
FIG. 2 is a rear perspective view of the mower blade sharpener apparatus of FIG. 1.

The present invention is directed in FIGS. 1 and 2 to a reciprocating mower blade holder apparatus 10 for use with a conventional stationary grinder device 12. The two elements 10 and 12 are positioned on a base 14. A reciprocating rotary mower blade sharpener housing frame 16 having an extended front side 18, an extended rear side 20, atop side 22, a bottom side 24, two tubular structures 25, and open opposite sides 26, 26, holds a rotary mower blade 28. The housing frame 16 has two aligned securing means such as an upper wingnut screw clamp 30 with a square end plate 32 inside positioned vertically from the top side 22, and a bottom wingnut screw clamp 34 with a V-shaped end plate 36 positioned vertically from the bottom side 24 for holding the rotary mower blade 28 at its center at an inclined angle conducive to sharpening a vertical 5° edge on the blade 28.

The housing frame 16 is mounted by an adjustable fastener 40, i.e., a carriage bolt and spring (hidden) in FIG. 1, onto a molded two-piece metal carriage 42. Carriage 42 is slidable by sets of six-ball bearings 43 (partially hidden) on two horizontal in-line cylindrical rails 44 (upper) and 46 (lower) supported by a main frame 48 at each end. The carriage 42 can optionally be one-piece. The carriage 42 is calibrated to reciprocate in a repeating cycle back and forth of approximately 4 inches in a cycle duration of approximately 1 second. The appropriate sharpening distance can be adjusted according to the length of the lawnmower's cutting edge.

The carriage 42 is attached in the rear to the extensible segment 50 of a pneumatic cylinder 52 mounted horizontally in the main frame 48 below the horizontal lower rail 46 by a bracket 54 as shown in FIG. 2. The pneumatic cylinder 52 is a single or double acting cylinder with an adjustable four-inch stroke operated by a directional valve 56 with a pneumatic tube 62 connected to the pneumatic cylinder 52. The pneumatic air at 120 psi is supplied by an accessory electrical pump (not shown).

The main frame 48 has two vertical angle iron ends 64, each having a vertical slot 66 for leveling bolts 68 to position the lawnmower blade 28 at a proper level relative to the grinder device 12. It is also understood that the grinder device 12 can be elevated for proper positioning. There are horizontal angle iron footings 70 with leveling bolts or feet 72 at each end attached to the vertical angle iron ends 64. An adjustable pneumatic valve 74 is positioned at the foot of the rear vertical frame end 64 to receive the pressured air at 120 psi in tube 76 from the remote air compressor (not shown) to feed by tube 62 to the directional valve 56 located on the carriage 42 proximate the upper rail 44. The adjustable pneumatic valve 74 is regulated in a preferred range of 15 to 20 psi.

The securing means in the housing frame 16 for the conventional rotary mower blade 28 can optionally be a pneumatic activated clamp (not shown) or a cam style clamp (not shown) The resharpening angle of blade 28 is preferably 5°.

The secured rotary mower blade 28 is sharpened by an affixed conventional rotary grindstone 86 with a flattened sharpening side 78. After sharpening one side, the blade 28 is reversed in the housing frame 16 to sharpen the blade's other side.

First end 80 of the main frame 48 has a transparent, flat, square acrylic shield 82 on a pivot 84 over the grindstone 86. A rotatable semicylindrical opaque acrylic shield 88 having a handle 90 is affixed to the upper rail 44 proximate the second opposite end 92 of the main frame 48 by a pair of rotatable hinges 94 to cover the portion of the rotary blade 28 not being sharpened. An on/off pneumatic valve 96 shown in FIG. 2 is positioned on another tube 98 attached to the carriage 42. The semicylindrical shield 88 is designed to rotate back and away from covering the mower blade 28 to press against the on/off pneumatic valve 96 to shut off the pneumatic air pressure for the reciprocating mower blade holder 10.

Figure 3A:
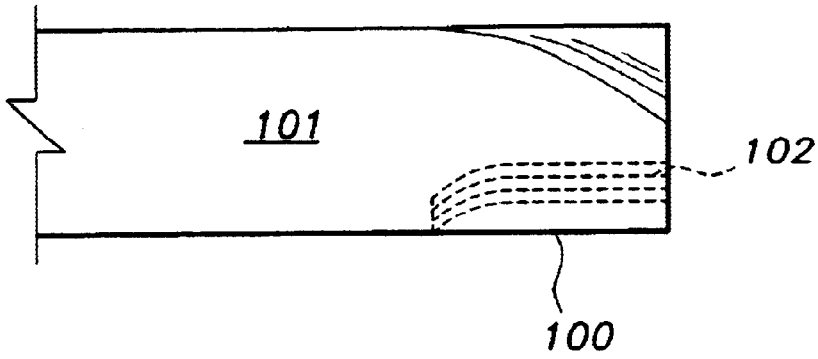
FIG. 3A is a partial elevational view of an incorrectly sharpened lawn mower blade.
Figure 3B:
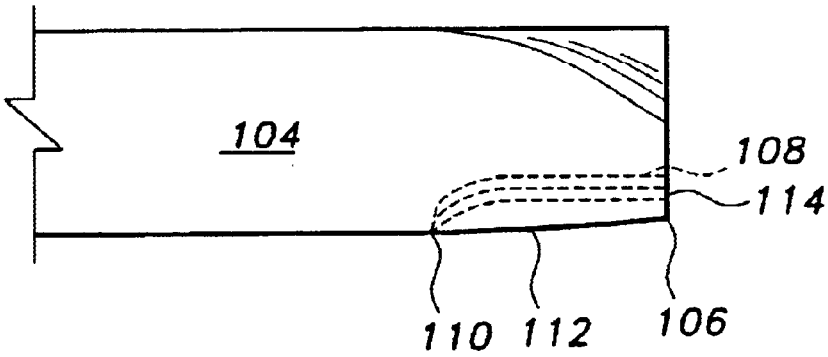
FIG. 3B is a partial elevational view of a correctly sharpened lawn mower blade produced automatically by the present apparatus.

FIGS. 3A and 3B illustrate, respectively, the improper sharpening and proper sharpening of a rotary mower blade. In FIG. 3A, the blade 101 has been sharpened with a sharp edge 100 which is in alignment with the remaining unsharpened portion of the blade, and has a ground area 102 having an equal width. FIG. 3B depicts a properly ground blade 104 which has been ground to remove the front portion in an inclined mode 106 and a ground blade area 108 having a narrow region 110 on the front edge 112 to increase in width to form a wide region 114 to the end of the blade 104. The total blade metal removed by grinding should not exceed a half-inch or 12.7 mm. at the blade tip.

Thus, an innovative lawnmower blade holder apparatus for sharpening with a fixed grinder has been shown which automatically grinds a lawnmower blade in a reciprocating measured movement with safety considerations provided by shields.

It is to be understood that the present invention is not limited to the embodiment described above, but encompasses any and all embodiments within the scope of the following claims.

I claim:

1. A reciprocating rotary mower blade sharpener holder apparatus comprising:

a housing frame having an extended front side and a rear side, a top side, a bottom side, and partially open opposite sides for holding a rotary mower blade;

said housing frame having a first securing clamp positioned vertically from the topside thereof, and projecting into the housing frame for horizontally holding the rotary mower blade on a V-shaped cradle of a second securing clamp projecting into the housing frame from below the housing frame to maintain the blade position conducive to sharpening of a vertical blade edge;

two horizontal cylindrical rails aligned vertically;

said housing frame mounted on a bracket calibrated to reciprocate in a repeating cycle and slidable on said two horizontal cylindrical rails aligned vertically; and said bracket attached to an expansion segment of a pneumatic cylinder mounted horizontally, and aligned below and to a side of said rails;

whereby the secured rotary mower blade is sharpened automatically in a reciprocating movement by a stationary rotary grinder wheel with flat sharpening sides.

2. The sharpener holder according to claim 1, wherein a second clamping screw is provided from the housing frame's bottom side to support the cradle and the rotary mower blade.

3. The sharpener holder according to claim 1, wherein a fastener is provided from the housing frame's front side to attach said housing frame to said slidable bracket.

4. The sharpener holder according to claim 1, wherein an air pressure source is provided for the pneumatic cylinder.

5. The sharpener holder according to claim 1, wherein a main frame supports the two horizontal rails, said main frame having a pair of vertical angle iron ends and a pair of horizontal angle iron footings.

6. The sharpener holder according to claim 5, wherein an adjustable pneumatic valve is positioned on the main frame adjacent the pneumatic cylinder.

7. The sharpener holder according to claim 6, wherein the pneumatic valve is regulated in a range of 15 to 20 psi.

8. The sharpener holder according to claim 1, wherein one frame end has a rotatable acrylic shield adapted to partially cover the rotary grinder wheel.

9. The sharpener holder according to claim 1, wherein a rotatable semicylindrical acrylic shield is affixed to the upper rail on a separate tubular support proximate an end opposite to the end adjacent the grinder wheel.

10. The sharpener holder according to claim 9, wherein an on/off pneumatic valve is positioned on said tubular support for closing the pneumatic air pressure when said shield is rotated away from the mower blade.

11. The sharpener holder according to claim 1, wherein the pneumatic cylinder is a single-acting cylinder with approximately a four-inch stroke.

* * * * *